US010181634B2

(12) United States Patent
Goswitz et al.

(10) Patent No.: US 10,181,634 B2
(45) Date of Patent: Jan. 15, 2019

(54) OUTDOOR UNIT CONFIGURED FOR CUSTOMER INSTALLATION AND METHOD OF ALIGNING SAME

(71) Applicant: The DIRECTV Group, Inc., El Segundo, CA (US)

(72) Inventors: Philip J. Goswitz, Rancho Palos Verdes, CA (US); Joseph Santoru, Agoura Hills, CA (US); Michael A. Thorburn, Long Beach, CA (US); Jeff Bentzler, Playa Del Rey, CA (US); Robert C. Tennant, Hermosa Beach, CA (US)

(73) Assignee: THE DIRECTV GROUP, INC., El Segundo, CA (US)

( * ) Notice: Subject to any disclaimer, the term of this patent is extended or adjusted under 35 U.S.C. 154(b) by 362 days.

(21) Appl. No.: 14/982,271

(22) Filed: Dec. 29, 2015

(65) Prior Publication Data

US 2017/0187089 A1 Jun. 29, 2017

(51) Int. Cl.
*H01Q 1/12* (2006.01)
*H01Q 3/08* (2006.01)

(52) U.S. Cl.
CPC ..... *H01Q 1/1207* (2013.01); *H01Q 1/125* (2013.01); *H01Q 3/08* (2013.01)

(58) Field of Classification Search
CPC .. H01Q 1/08; H01Q 1/12; H01Q 3/08; H01Q 3/12
USPC ..... 343/757, 781, 878–883, 890–892
See application file for complete search history.

(56) References Cited

U.S. PATENT DOCUMENTS 7,408,526 B2 * 8/2008 Pan ..... H01Q 1/125 343/880
7,663,565 B2 * 2/2010 Son ..... H01Q 1/125 248/183.1
8,350,778 B2 * 1/2013 Yeh ..... H01Q 3/06 343/878

* cited by examiner

*Primary Examiner* — Dameon E Levi
*Assistant Examiner* — Hasan Z Islam
(74) *Attorney, Agent, or Firm* — Gates & Cooper LLP

(57) ABSTRACT

A method and apparatus for angularly aligning an antenna disposed at a geographical location is disclosed. A corresponding apparatus comprises a plurality of reticle members, each reticle member having a reticle, and a plurality of reference members, each adjustably engaged with an associated one of the plurality of reticle members, wherein each of the plurality of reference members comprises an associated template having a reference mark positioned thereon according to the geographical location of the antenna and the antenna is angularly aligned when each reference mark of each template is aligned with the reticle associated with the reference mark. A corresponding method comprises the steps of affixing an associated template having a reference mark positioned thereon according to the geographic location of the antenna to each of the plurality of reference members and angularly aligning each of the plurality of reticle members with each reference mark of each associated template.

25 Claims, 21 Drawing Sheets

OUTDOOR UNIT CONFIGURED FOR CUSTOMER INSTALLATION AND METHOD OF ALIGNING SAME

BACKGROUND OF THE INVENTION

1. Field of the Invention

The present invention relates to systems and methods for aligning terrestrially based antennas, and in particular to an outdoor unit configured for customer installation and alignment.

2. Description of the Related Art

Satellite transception of communications signals has become commonplace. Satellite distribution of commercial signals for use in television programming currently utilizes multiple feedhorns on a single Outdoor Unit (ODU) which supply signals to one or more receivers (also known as set top boxes or STBs or Integrated Receiver/Decoders or IRDs).

Typically, the ODU comprises an antenna that is aligned so as to direct its sensitive axis to a location that optimizes reception from all relevant satellites. This is accomplished by coarse aligning the antenna so as to receive a signal transmitted by a selected one of the satellites, and then fine-tuning the alignment using a power meter or other alignment tools.

Proper coarse alignment is critical, because the desired satellite may reside in orbital locations close to other nearby satellites and without accurate course alignment, the fine alignment process may mistakenly direct the antenna's sensitive axis at the wrong satellite. Proper fine alignment is likewise critical, as proper alignment assures that the antenna is properly aimed to optimize reception (and transmission, if relevant) of the signals from all transponders of all of the satellites of interest.

Although some consumers may be capable of installing and aligning the antenna to sufficient accuracy, other consumers are not so capable. The result is dissatisfied customers and unnecessary service calls. Hence, currently, such installations are performed either by qualified service technician at the installation location, or in mobile applications, performed using expensive automatic alignment equipment.

What is needed is a method and apparatus that simplifies installation and alignment to the point where it can be accomplished by almost all of consumers, without the need for qualified service technicians. The apparatus and method below satisfies this need.

SUMMARY OF THE INVENTION

To address the requirements described above, the present invention discloses a method and apparatus for angularly aligning an antenna disposed at a geographical location. In one embodiment, the apparatus comprises a plurality of reticle members, each reticle member having a reticle, and a plurality of reference members, each adjustably engaged with an associated one of the plurality of reticle members, wherein each of the plurality of reference members comprises an associated template having a reference mark positioned thereon according to the geographical location of the antenna and the antenna is angularly aligned when each reference mark of each template is aligned with the reticle associated with the reference mark. In another embodiment, the method comprises the steps of affixing an associated template having a reference mark positioned thereon according to the geographic location of the antenna to each of the plurality of reference members and angularly aligning each of the plurality of reticle members with each reference mark of each associated template. These features provide significant advantages, including:

Simplified Leveling Scheme: Currently, the procedure for mounting the antenna begins with installing a mounting pole in a vertical (parallel to the gravity vector) position. The improved system includes simplified leveling apparatus which does not require setting the mounting pole in a vertical position. An integrated bubble level may also be provided to aid in leveling the alignment apparatus.

Integrated Compass: Selected embodiments of the alignment apparatus include an integrated magnetic compass. This compass can be used to align the alignment apparatus toward a known heading, such as geomagnetic North with sufficient accuracy to achieve coarse alignment. In this context, coarse alignment occurs when the antenna is sufficiently aligned so as to receive, albeit poorly, a signal from the appropriate satellite transponder. For example, when the antenna is coarsely aligned, at least some Ku-band transponders 107 from the 101 orbital slot can be received and decoded by a receiver so that nonzero signal quality values are reported by the receiver (signal-to-noise values converted to a zero to 100 scale).

Coarse Alignment Enabled by Color-Coded Templates Custom Printed According to the Installation Location: Rather than provide end users with an alignment apparatus with graduated scales and ask that the consumer properly orient the alignment apparatus using those scales (e.g. by adjusting the alignment apparatus to values on those graduated scales, the alignment apparatus uses color-coded templates which have pre-printed marks indicating the desired antenna orientation.

These pre-printed templates are sized and shaped so that they unambiguously fit only one location and orientation on the alignment apparatus. Further, the templates are color coded with other alignment apparatus elements to assure the proper templates are used with the associated elements of the alignment apparatus. Further, the templates may be asymmetric about any axis so that they can only be placed on the appropriate member of the alignment apparatus in the proper location and orientation.

The end-consumer need only mount the templates to the alignment apparatus, and line up the marks on the templates with associated cursors in azimuth, elevation and tilt directions. The resulting pointing is performed with sufficient accuracy to achieve coarse antenna alignment.

Integrated Fine Alignment After Alignment Apparatus is Fully Assembled: The fully assembled alignment apparatus includes fine adjustment mechanisms so that after assembly, signal reception may be optimized.

BRIEF DESCRIPTION OF THE DRAWINGS

Referring now to the drawings in which like reference numbers represent corresponding parts throughout.

DETAILED DESCRIPTION OF PREFERRED EMBODIMENTS

In the following description, reference is made to the accompanying drawings which form a part hereof, and which is shown, by way of illustration, several embodiments of the present invention. It is understood that other embodiments may be utilized and structural changes may be made without departing from the scope of the present invention.

Distribution System

Figure 1:
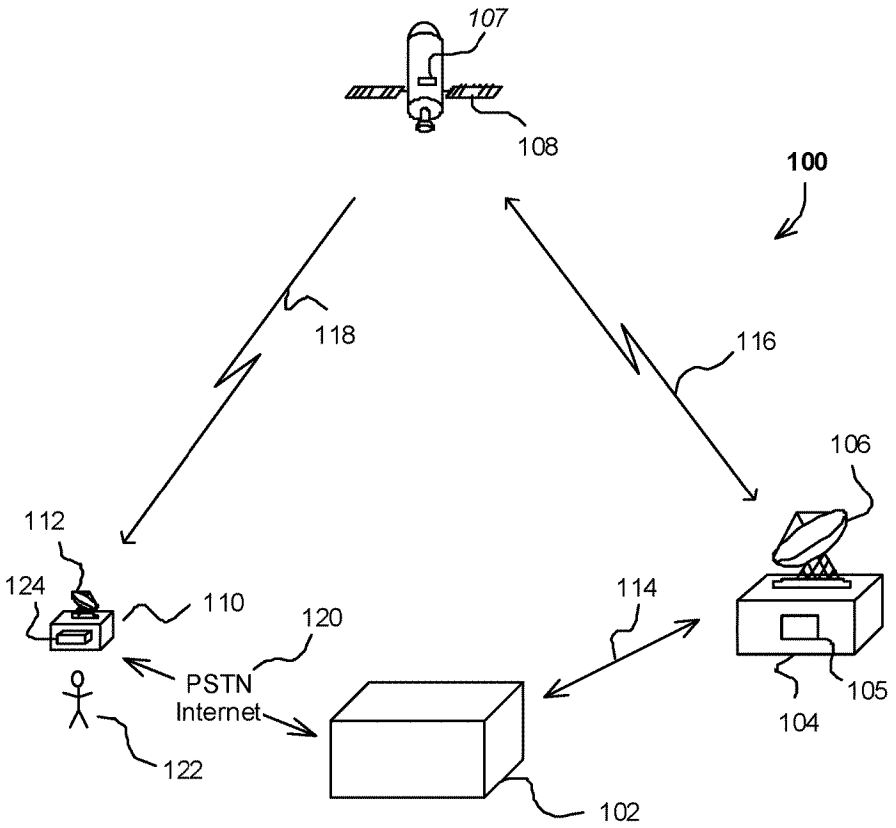
FIG. 1 PRIOR ART
FIG. 1 is a diagram illustrating an overview of a distribution system that an be used to provide video data, software updates, and other data to consumers.

FIG. 1 is a diagram illustrating an overview of a distribution system 100 that an be used to provide video data, software updates, and other data to subscribers. The distribution system 100 comprises a control center 102 in communication with an uplink center 104 via a ground or other link 114 and with a subscriber receiver station 110 via a public switched telephone network (PSTN) or other link 120. The control center 102 provides program material (e.g. video programs, audio programs, software updates, and other data) to the uplink center 104 and coordinates with the subscriber receiver stations 110 to offer, for example, pay-per-view (PPV) program services, including billing and associated decryption of video programs.

The uplink center 104 receives program material and program control information from the control center 102, and using an uplink antenna 106 and transmitter 105, transmits the program material and program control information to one or more satellite 108A-108N (hereinafter alternatively referred to as satellite(s) 108). The satellite 108 receives and processes this information, and transmits the video programs and control information to the subscriber receiver station 110 via downlink 118 using one or more transponders 107 or transmitters. The subscriber receiving station 110 receives this information using the outdoor unit (ODU) 112, which includes a subscriber antenna.

The distribution system 100 can comprise a plurality of satellites 108 in order to provide wider terrestrial coverage, to provide additional channels, or to provide additional bandwidth per channel. For example, each satellite may comprise 16 transponders 107 to receive and transmit program material and other control data from the uplink center 104 and provide it to the subscriber receiving stations 110.

While the features disclosed herein will be described with reference to a satellite-based distribution system 100 transmitting media programs, they may also be practiced in any embodiment requiring alignment of a transmitting antenna with a reference position. This may also include terrestrial to terrestrial transmission.

Figure 2:
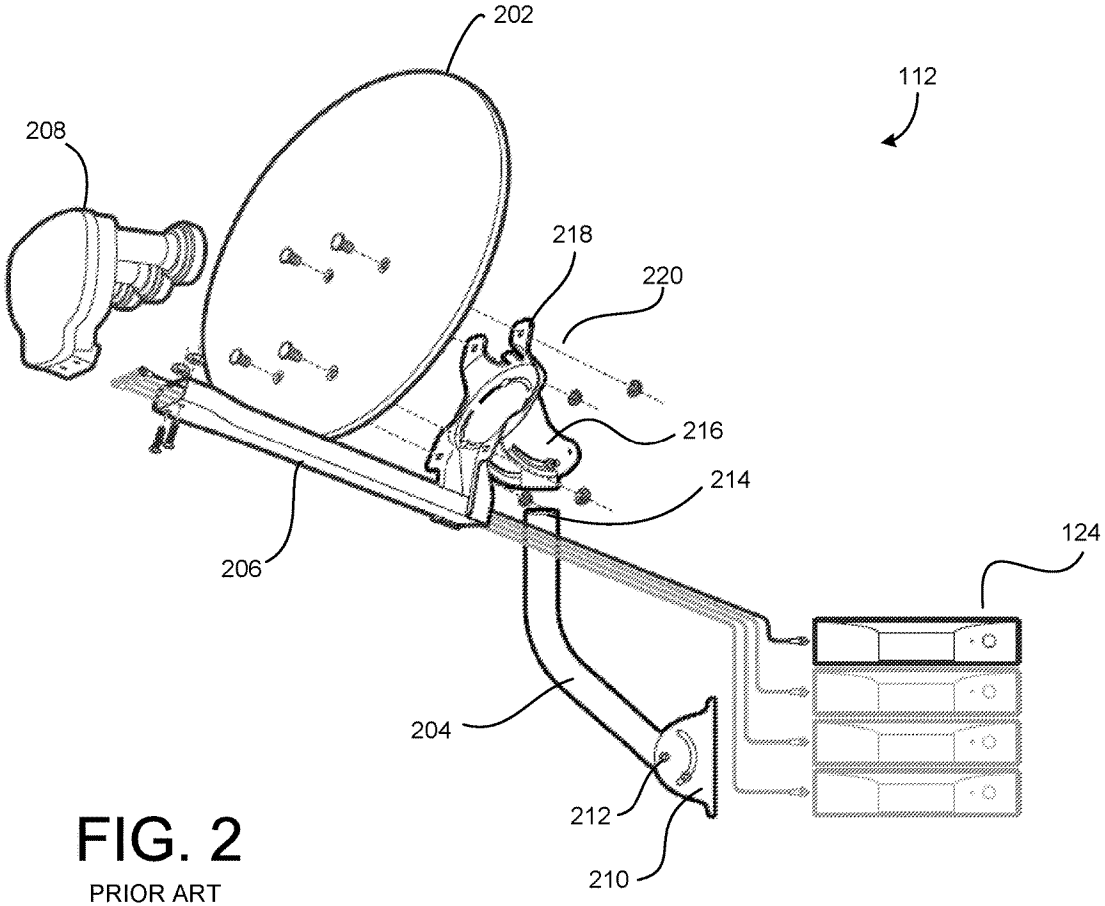
FIG. 2 PRIOR ART
FIG. 2 is diagram illustrating a prior art outdoor unit (ODU)

FIG. 2 illustrates a prior art ODU 112. ODU 112 includes an antenna, which typically comprises a feedhorn assembly 208 and reflector dish 202 to direct downlink signals 118 onto feedhorn assembly 208. The reflector dish 202 and LNB 208 are mounted to a bracket assembly 220 having a first member 218 that permits the dish 202, feedhorn assembly 208 and boom 206 to be adjusted about a tilt axis. The bracket assembly first member 218 is also coupled to bracket assembly second member 216, which allows the bracket assembly second member to be adjusted in elevation. The bracket assembly second member 216 is coupled to a mast 204, which permits adjustment in azimuth. The mast 204 is coupled to anchor 210, which may be affixed to an outside surface of a structure such as a dwelling. Anchor 210 includes a leveling mechanism 212 that permits the mast 204 to be oriented so that the distal end of the mast (where the bracket assembly second member 216 is mounted) is level.

Figure 3:
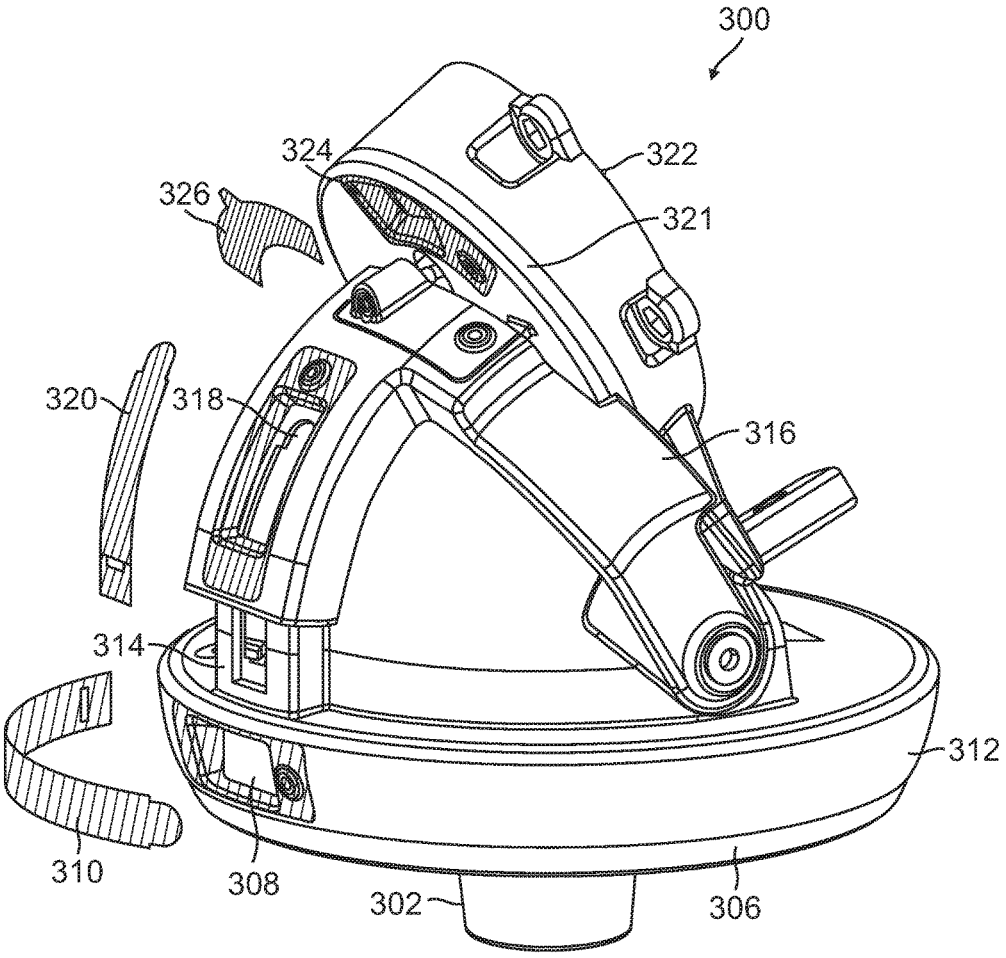
FIG. 3 is a diagram illustrating one embodiment of the alignment apparatus.

FIG. 3 is a diagram illustrating one embodiment of the alignment apparatus 300. In the illustrated embodiment, the alignment apparatus comprises a plurality of reticle members 312, 316, 321, each having an associated reticle 308, 318, 324. In the illustrated embodiment, the plurality of reticle members includes an azimuth reticle member 312, an elevation reticle member 316, and a tilt reticle member 321.

The alignment apparatus 300 also comprises a plurality of reference members 306, 314 and 322. In the illustrated embodiment, the plurality of reference members includes an azimuth reference member 312, an elevation reference member 314, and a tilt reference member 322. Each of the plurality of reference members 306, 314 and 322 comprises an associated template 310, 320 and 326 having a reference mark positioned thereon. The reference mark is located at a position according to the geographical location where the antenna is to be installed. Hence, the azimuth reference member 312 includes an associated azimuth reference template 310 mounted thereon, the elevation reference member 314 includes an associated elevation reference template 320 mounted thereon, and the tilt reference member 322 includes an associated tilt reference template 326 mounted thereon. Also, each reticle member comprises an associated reticle as well. Hence, azimuth reticle member 312 includes azimuth reticle 308, elevation reticle member 316 includes elevation reticle 318 and tilt reticle member 321 includes tilt reticle 324.

The antenna alignment apparatus 300 (and hence, the antenna attached to the antenna alignment apparatus 300) is angularly aligned to direct the antenna in a desired direction (e.g. at a satellite 108 or other element of interest) when each reference mark of each template 310, 320, and 326 is aligned with a cursor of the associated reticle 308, 318, and 324 as is further described below. The alignment apparatus 300 also comprises a base member 302 that can be used to mount the alignment apparatus 300 on a mast or similar structure. The azimuth reference member 306 mounts to the base as described further below.

Figure 4C:
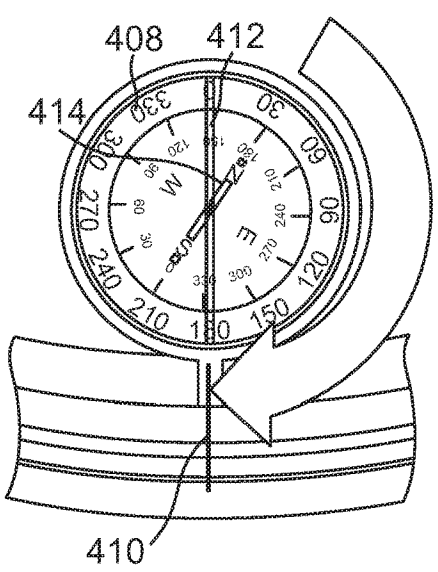
FIGS. 4A-4C are diagrams of an exemplary embodiment of the base unit and its interface with the azimuth reference member.
Figure 4B:
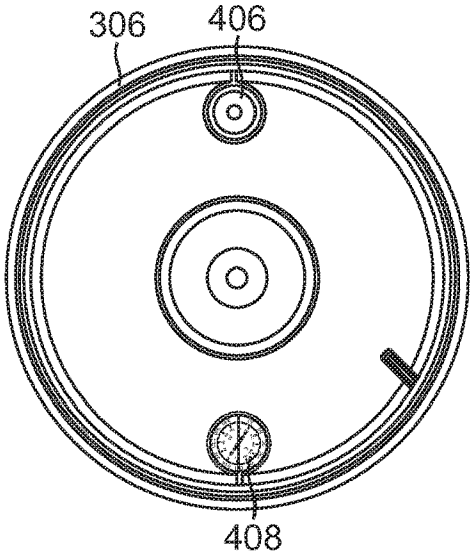
Figure 4A:
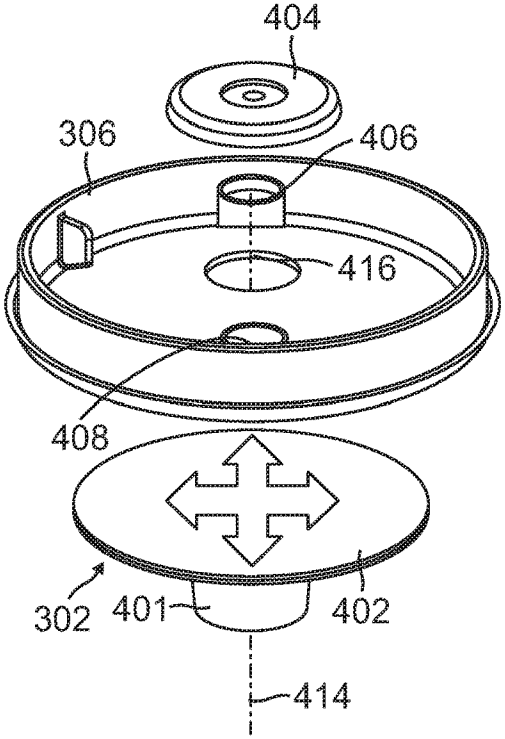

FIGS. 4A-4C are diagrams of an exemplary embodiment of the base member 302 and its interface with the azimuth reference member 306. The base member 302 comprises a mounting portion 401 for mounting to a mast or similar structure, and a base member surface 402 substantially spherical about a base member axis 414. The azimuth reference member 306 has an azimuth reference member surface (the side facing the base member surface 402) that is also substantially spherical about an azimuth axis 416. The spherical surface 402 of the base member 302 and the spherical surface of the azimuth reference member 306 are sized and shaped so as to allow them to swivelingly engage each other, so that that the azimuth axis 416 is adjustable relative to the base member axis 414 in two degrees of freedom as illustrated. This allows the azimuth reference member 306 (and hence, the alignment apparatus 300) to be leveled so as to be perpendicular to a gravity vector.

To assist such leveling, the azimuth reference member 306 comprises a level 406. In one embodiment, the level 406 comprises a bubble level sensitive in two orthogonal directions. The bubble level includes a vessel incompletely filled with a liquid, thus resulting in a bubble, and a circular graduation. The user adjusts the azimuth reference member 306 relative to the base member 302 to orient the bubble so as to be evenly circumscribed by the circular graduation, thus leveling the azimuth reference member 306 (and hence, the rest of the alignment apparatus 300).

As a part of the alignment process, the alignment apparatus 300 must also be oriented in the proper heading. This can be accomplished by rotating the azimuth reference member 306 about the azimuth axis 416 with respect to base member 302 to properly orient the azimuth reference member 306 towards the desired heading (such as magnetic north). To aid in this process, the azimuth reference member 306 may also comprise a compass 408 having needle 414 and a transparent cursor 412 aligned with an indicator 410. In one embodiment, every compass 408 is installed in the same orientation relative to the azimuth reference member 306, and the user is provided an angle value related to the desired offset from magnetic north. The azimuth reference member 306 is oriented to the proper heading by rotating the azimuth reference member 306 about the azimuth axis 414 until the angle value (in the illustrated embodiment, 180 degrees) is achieved. In other embodiments, the indicator 410 or cursor 412 is custom-aligned to the proper direction, and the user rotates the azimuth reference member 306 about the azimuth axis 414 until the needle 414 is aligned with the cursor 414. This has the advantage in relieving the user of the need to understand how to read the compass 408.

Notably, the foregoing concentric sphere geometry of the relevant surfaces can be used to level and point north at the same time, with both a bubble level 406 and compass 408 simultaneously referenceable.

Once leveled and aligned, azimuth reference member 306 can be secured to the base member 302 by tightening locking ring member 404.

Figure 5:
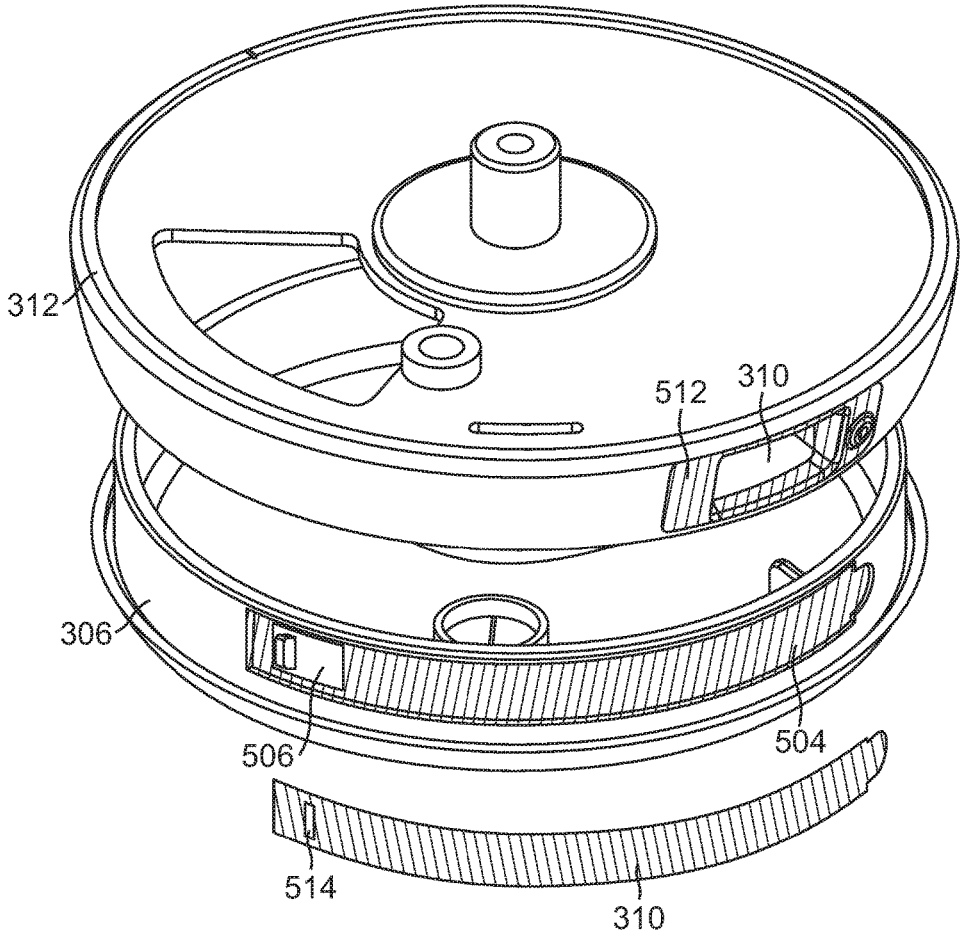
FIG. 5 is a diagram illustrating one embodiment of the mounting of the azimuth template on the azimuth reference member; and assembly of the azimuth reticle member with the azimuth reference member.
Figure 6A:
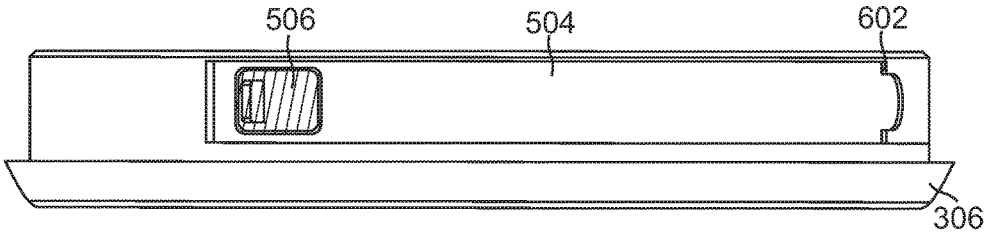
FIGS. 6A-6D are diagrams further illustrating the azimuth template and matching physical features of the azimuth reference member.
Figure 6B:
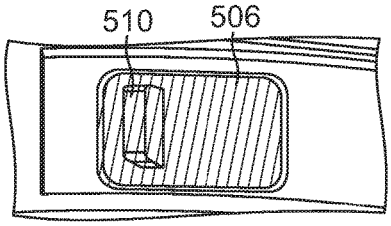
Figure 6C:
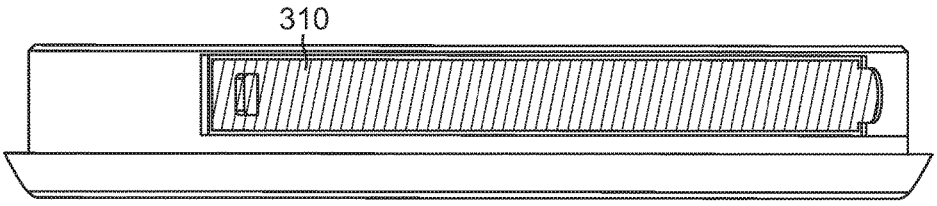
Figure 6D:
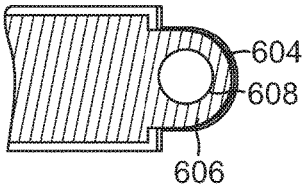

FIG. 5 is a diagram illustrating one embodiment of the mounting of the azimuth template 310 on the azimuth reference member 306, and assembly of the azimuth reticle member 312 with the azimuth reference member 306. The azimuth reference member 306 comprises one or more physical features that match the associated azimuth template 310. These physical features permit precise location of the azimuth template 310 to the azimuth reference member 306. In the illustrated embodiment, the physical features comprise a depression 504 having an outline shape matching the outline shape of the azimuth template 310.

FIGS. 6A-6D are diagrams further illustrating the azimuth template 310 and matching physical features of the azimuth reference member 306. In this embodiment, the physical features also comprise a positioning hook or tab 510 extending from an area 506 color coded to match the color of the azimuth template 310. The azimuth template 310 comprises a slot 514 sized to accept the tab 510. The azimuth template 310 is mounted to the azimuth reference member 306 such that tab 510 fits through the slot 514, and the azimuth template 310 fits within and against the boundaries of the depression 504 in the azimuth reference member 306 of matching shape. In the illustrated embodiment, the physical features includes an end portion 602 having a semi-circle 604 with linear extensions 606. In one embodiment, the reference template 310 is inserted so that the reference template matching features are in contact with the semi-circular feature 604 and linear portion 606. Once placed on the reference member, the reference templates may be secured using an adhesive, for example, in adhesive area 608.

In one embodiment the associated reticles, templates, and locations where the templates are to be installed are color coded (e.g. fashioned of the same color) to reduce errors in the process of installing the template on the reference member and the reticle member on the reference member. For example, azimuth template 310 may be green in color, matching the color of the area 506 where the template 310 should be mounted to the associated tab 510, and the reticle 308 of the reticle member 312 may also be of matching green color.

Figure 7:
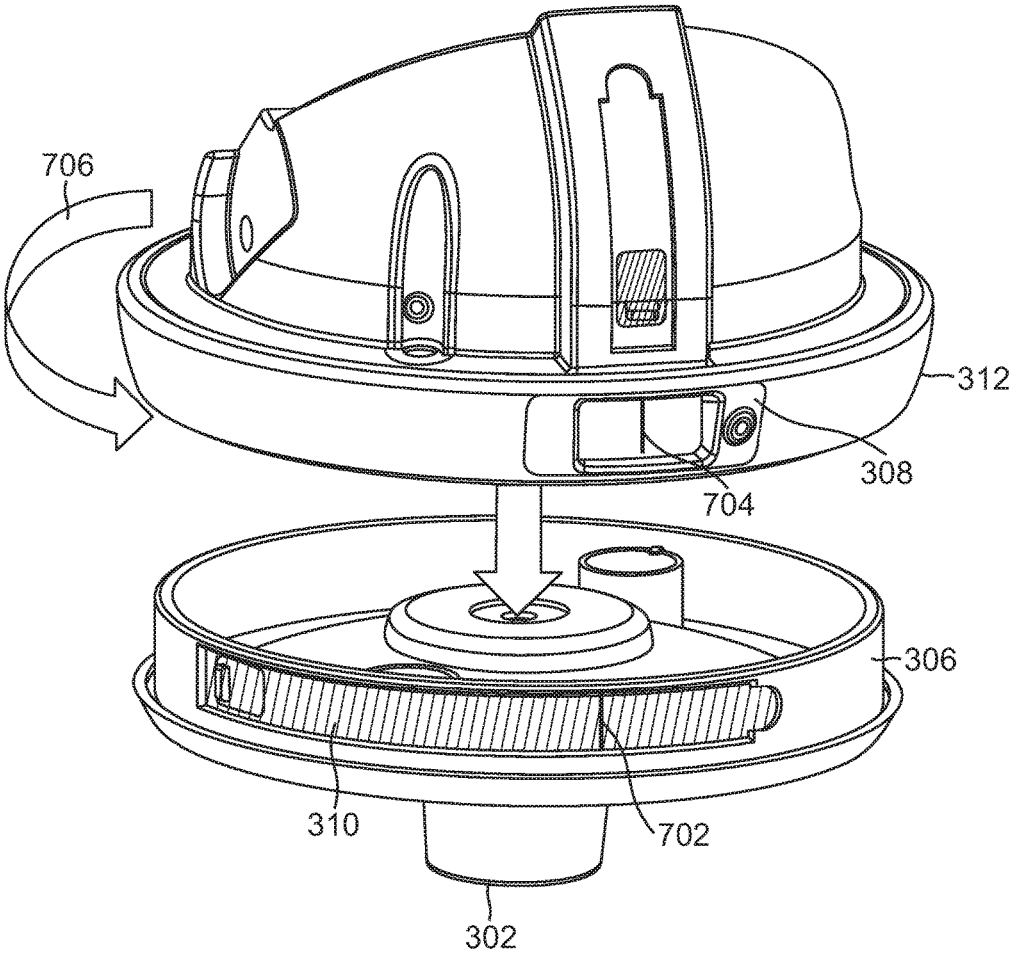
FIG. 7 is a diagram illustrating the mounting of the azimuth reticle member on the azimuth reference member.

FIG. 7 is a diagram illustrating the mounting of the azimuth reticle member 312 on the azimuth reference member 306. The azimuth reticle member 312 can then rotate (e.g. in direction of arrow 706) with respect to the azimuth reference member 306, with the azimuth template 310 appearing behind reticle 308. When the azimuth reticle member 312 is in the proper position relative to the azimuth reference member 306, the reference mark 702 of the reference template 310 is aligned with a cursor 704 of the azimuth reticle 308.

Figure 8:
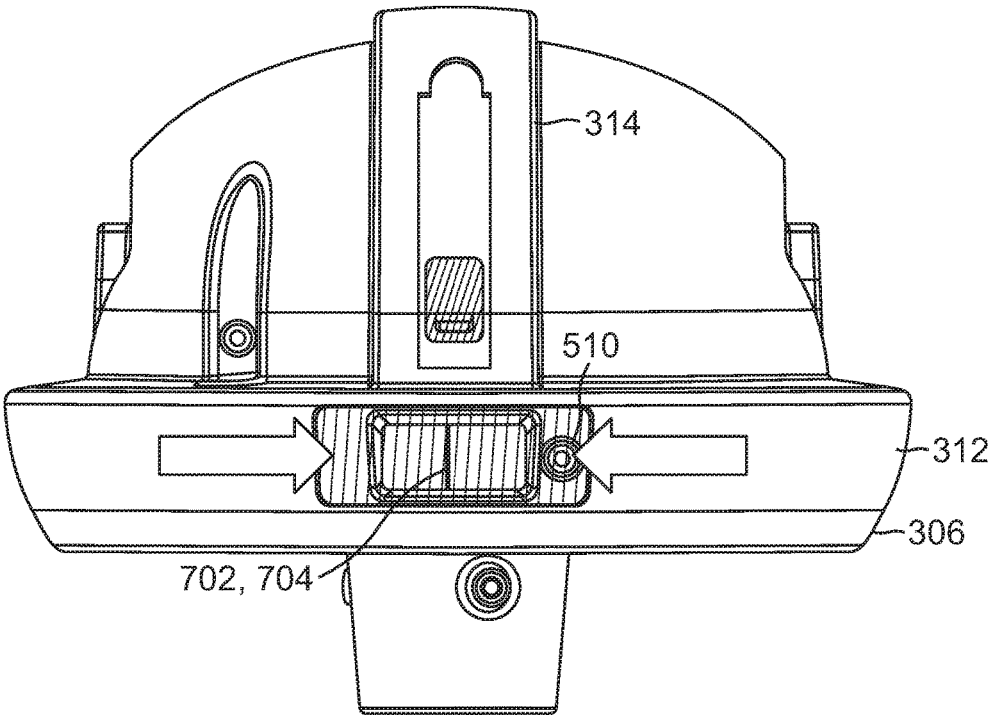
FIG. 8 is a diagram illustrating the azimuth reference member and the azimuth reticle member in their aligned orientation.

FIG. 8 is a diagram illustrating the azimuth reference member 306 and the azimuth reticle member 312 in their aligned orientation (e.g. with cursor 704 matched to reference mark 702). After such adjustment, the azimuth reference member 306 and azimuth reticle member 312 can be restrained from angular rotation with respect to one another by means of fixing mechanism 510, which may comprise a screw inserted through an aperture of the azimuth reticle member and interfacing an associated structure of the azimuth reference member 306.

Figure 9:
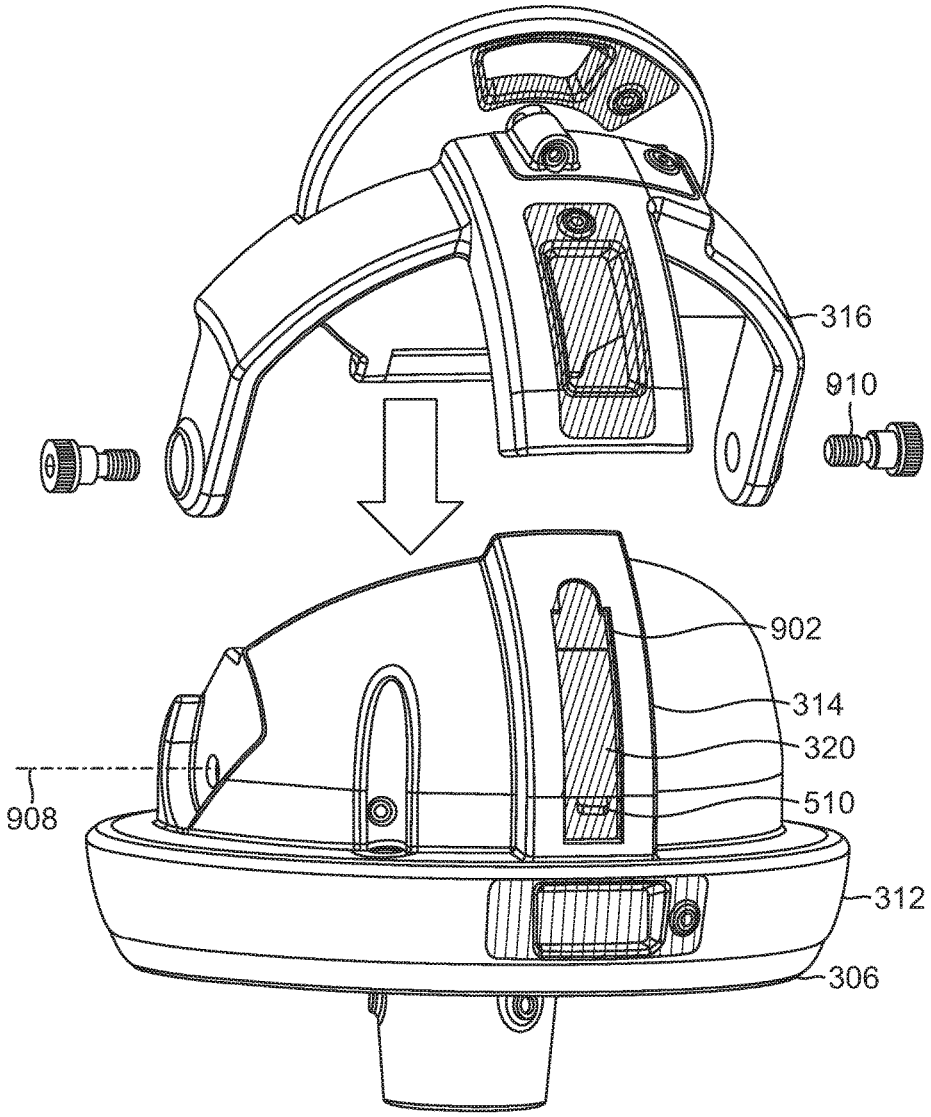
FIG. 9 is a diagram illustrating the mounting of the elevation reticle member to the elevation reference member.

FIG. 9 is a diagram illustrating the mounting of the elevation reticle member 316 to the elevation reference member 314. In one embodiment, the elevation reference member 314 is integrated or pre-assembled with the azimuth reticle member 312 (e.g. provided to consumers assembled together). This simplifies the design of the azimuthal fine adjustment mechanism described further below. However, in other embodiments, the elevation reference member 314 is mounted to the elevation reference member 312 by consumers or installers.

As was the case with the azimuth reference member 306 and azimuth template 310, the elevation reference member 314 includes physical features 902 that permit precise mounting of the elevation template 320, which has matching physical features. For example, the elevation reference member 314 may have a tab 906 analogous to the tab 510 of the azimuth reference member 306, and the elevation reference template 320 may include a slot or aperture through which the tab 906 is inserted.

The elevation reticle member 316 is affixed to the elevation reference member 314 so that it may rotate around the elevation reference member 314 about an elevation axis 908. This can be accomplished via fixing members such as bolts 910 inserted into appropriate apertures in the elevation reference member 314.

Figure 10:
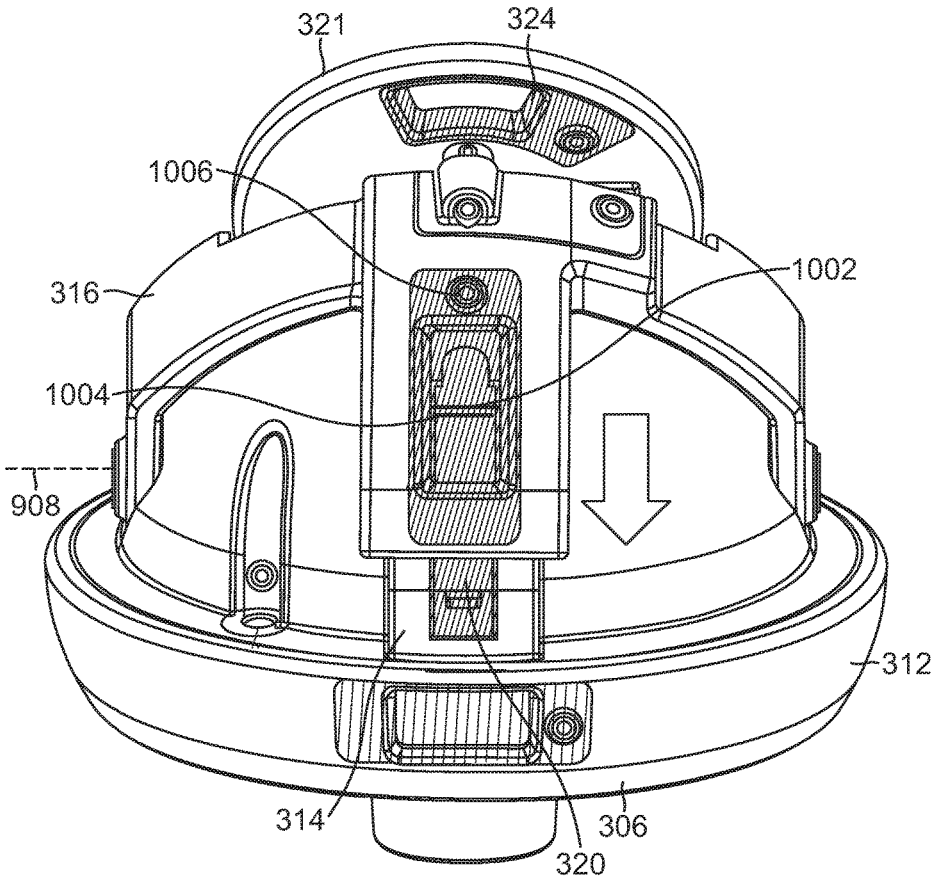
FIG. 10 is a diagram illustrating the alignment apparatus with the elevation reticle member installed on the elevation reference member.

FIG. 10 is a diagram illustrating the alignment apparatus 300 with the elevation reticle member 316 installed on the elevation reference member 314. The elevation reticle member 316 can then be moved about elevation axis 908 until the reference mark 1004 on the elevation template 320 is aligned with the elevation reticle cursor 1002, at which point, the alignment apparatus 300 is aligned in elevation.

This alignment position may be fixed using affixing mechanism such as a screw inserted in aperture 1006. FIG. 10 also partially illustrates the tilt reticle member 321, mounted to the elevation reticle member 316, having the tilt reticle 324.

Figure 11:
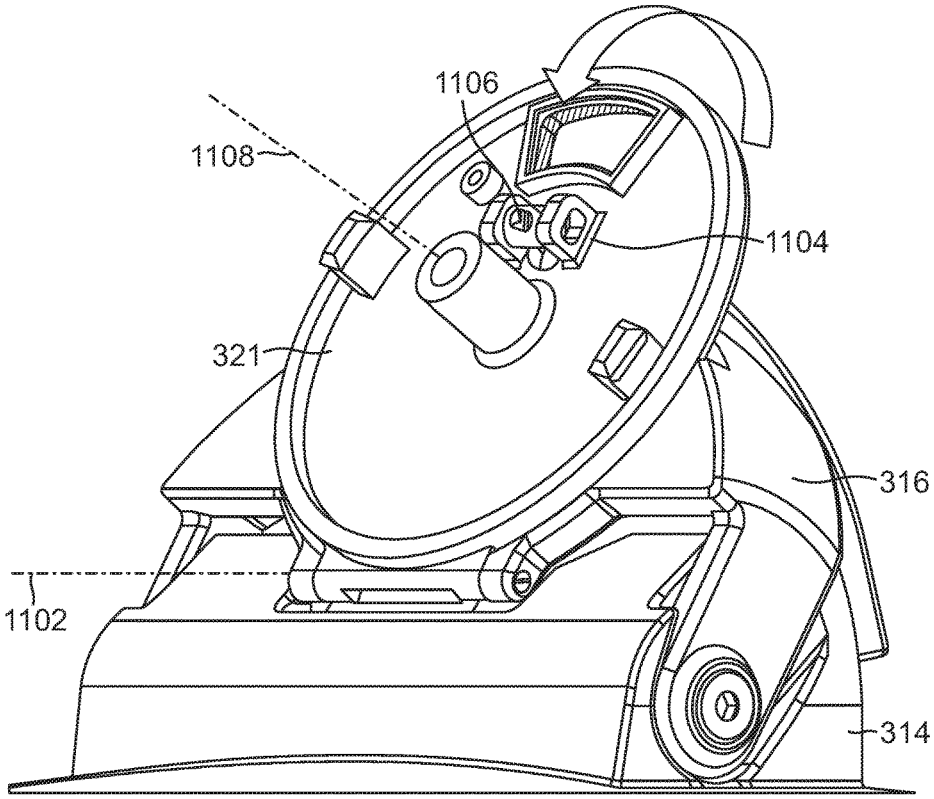
FIG. 11 is a diagram showing how the tilt reticle member may be mounted on the elevation reticle member so as to rotate about secondary elevation axis parallel to the elevation axis and a tilt axis.

FIG. 11 is a diagram showing how the tilt reticle member 321 may be mounted on the elevation reticle member 316 so as to rotate about secondary elevation axis 1102 parallel to the elevation axis 908 and a tilt axis 1108. FIG. 11 also illustrates a portion of an elevation fine adjustment mechanism comprising a stanchion 1104 and rotating nut member 1106 for fine adjusting the alignment apparatus 300 about the secondary elevation axis 1102, as further described herein. In one embodiment, the tilt reticle member 321 is provided to the end-consumer pre-assembled with the elevation reticle member 316 as shown. In other embodiments, the consumer mounts the tilt reticle member 321 to the elevation reticle member 316 using one or more fastening members.

Figure 12:
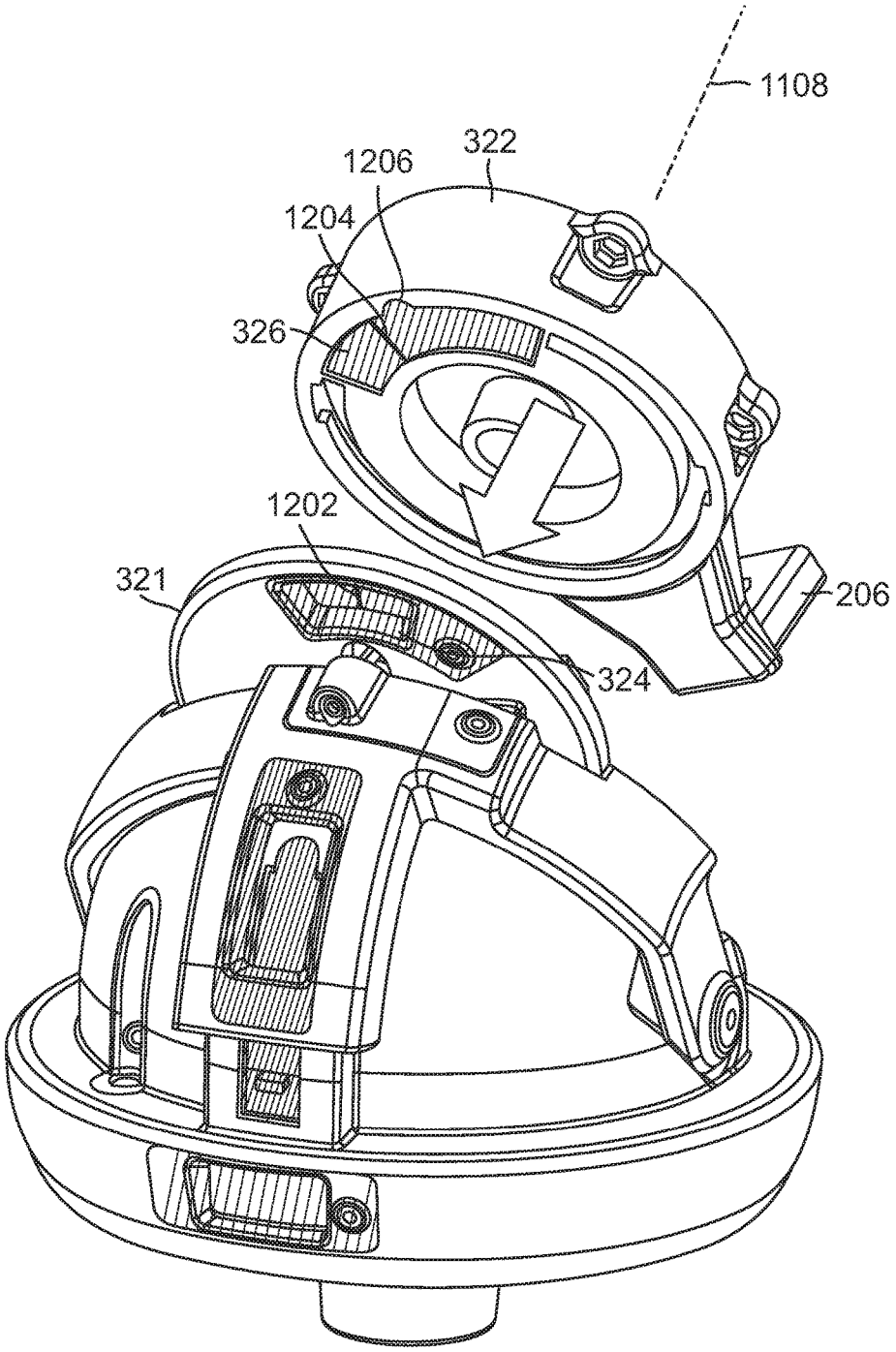
FIG. 12 is a diagram illustrating the mounting of the tilt reference member to the tilt reticle member.

FIG. 12 is a diagram illustrating the mounting of the tilt reference member 322 to the tilt reticle member 321. A tilt reference template 326 is precision mounted on the tilt reference member 322 in the proper location and orientation due to matching physical features of the tilt reference template 326 and the tilt reference member 322. In the illustrated embodiment, the matching physical features comprise two semi-circular boundaries (one on the top of the tilt reference member 322 and template 326, and one on the bottom of the tilt reference member 322 and template 326. A further circular physical feature is also present on the upper portion of the tilt reference template 326 and the tilt reference member 322. Once mounted to the tilt reticle member 321, the tilt reference member 322 can be rotated about the tilt axis 1108 to align the alignment apparatus 300 about the tilt axis 1108. This is accomplished by aligning the reference mark 1204 of the tilt reference template 326 with the cursor 1202 of the tilt reticle member 321. Although not illustrated, a tab and aperture structure may also be utilized, as was the case with the azimuth and elevation members.

Figure 13:
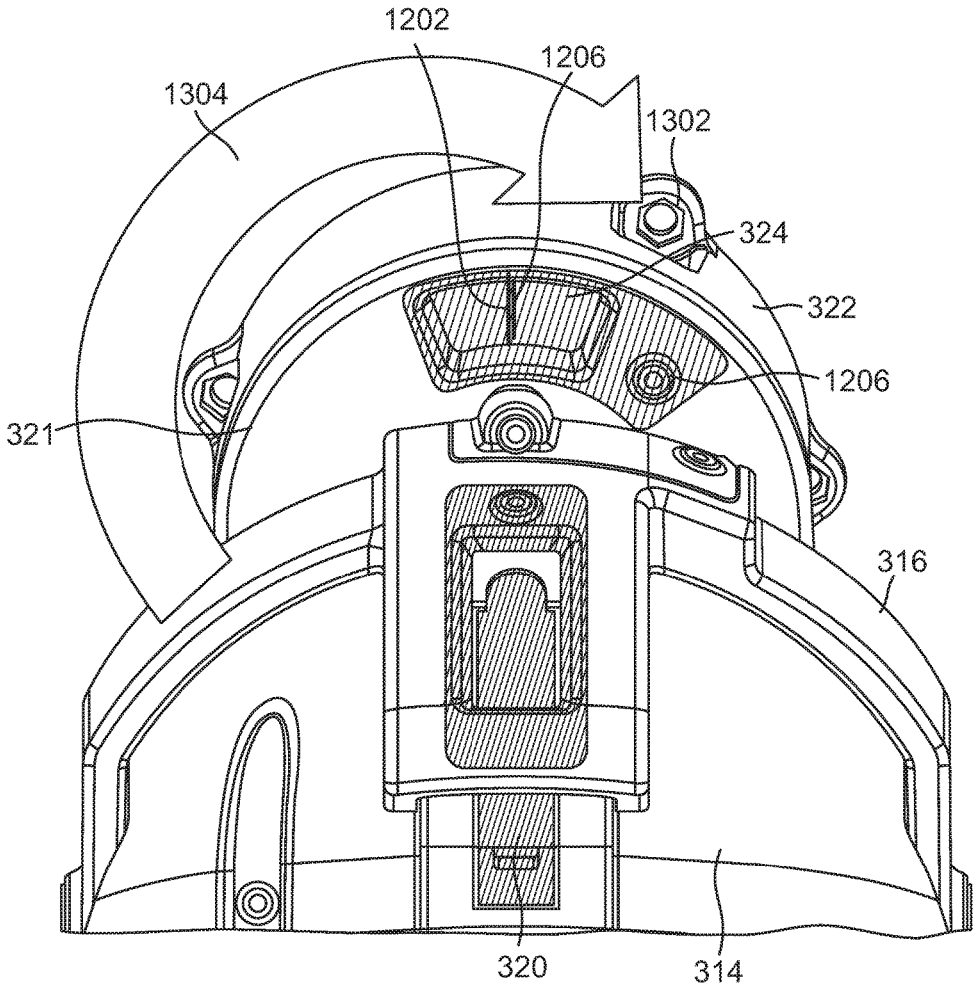
FIG. 13 is a diagram illustrating how the alignment apparatus can be aligned about the tilt axis.

FIG. 13 is a diagram illustrating how the alignment apparatus 300 can be aligned about the tilt axis 1108. After mounting the tilt reference member 322 to the tilt reticle member 321, the tilt reference member 322 is rotated until the tilt reference mark 1204 is aligned with the cursor 1202 of the tilt reticle 321. After such alignment, the tilt reticle member 321 and the tilt reference member 322 may be affixed to prevent further relative rotation by means of affixing mechanism 1206, which may comprise a screw.

The foregoing alignment of the device may be performed with most or all of the antenna structure mounted to the alignment apparatus 300 or with the antenna not mounted to the alignment apparatus 300. As the weight of the antenna may skew some of the adjustments (e.g. in elevation and tilt), the antenna structures may be attached to the alignment apparatus 300 (e.g. by attaching dish 202 to the tilt reference member 322 using mounting holes 1302 and the boom 206 to boom mount 1208, the LNB 208 to the boom 206, and routing a cable from the LNB 208 to the receiver 124), and the alignment rechecked using the associated reticles and template reference marks for each axis (azimuth, elevation, and tilt), and set in place with the associated set screws after the antenna structures have been added to the alignment apparatus 300.

This assembly and alignment process completes a coarse alignment of the antenna using the alignment apparatus 300. Notably, the foregoing operations do not require that the antenna actually receive a signal. Instead, the antenna is coarse aligned to a point in space using a ground datum (offered by a level base structure oriented in the proper heading) and the alignment of each template mark with the associated reticle cursor.

The antenna may now be "fine" aligned using fine adjustment mechanisms as further described below. As further described below, this may be accomplished by tuning the receiver 124 to receive a signal from a particular transponder 107 of a particular satellite 108 (and preferably at a particular polarization), and fine adjusting the alignment apparatus 300 in the relevant axes to maximize signal reception. A demodulator in the receiver 124 may be used to peak the signal by maximizing the signal quality meter reading, which may comprise a signal-to-noise ratio of the signal received from the selected transponder normalized to a 0 to 100 scale.

In one embodiment, the transponder used for fine alignment is a Ka-band transponder, and the signal used for fine alignment is transmitted at a particular polarization. This is because the antenna beam pattern is typically tighter (has a smaller half power beamwidth) in the Ka band than the Ku band, and this smaller beamwidth allows for pointing to within a few tenths of a degree of the peak of the beam. Further, the center of the antenna's beam pattern is not constant for different polarizations. Hence, the choice of transponder and polarization is important because the beamwidth of the antenna in the selected frequency band impacts the accuracy of the alignment, and polarization will impact the bias introduced during the pointing process.

The selected polarization used may depend on the Topocentric angle (the angle formed by imaginary straight lines that join two given points in space with a specific point on the surface of the Earth) so that a right-hand circularly polarized transponder may be used at some locations and a left-hand circularly polarized transponder at others. This simplified peaking approach is different from other schemes that use dithering. The simple peaking approach is very simple to use and the alignment apparatus mechanisms are simplified. But it is recognized that the dithering approach (and also other schemes that measure the signal-to-noise ratio for multiple transponders and then use a curve fitting approach to final the optimal position) may provide slightly better positioning and are more tolerant to mispointing errors.

Figure 14:
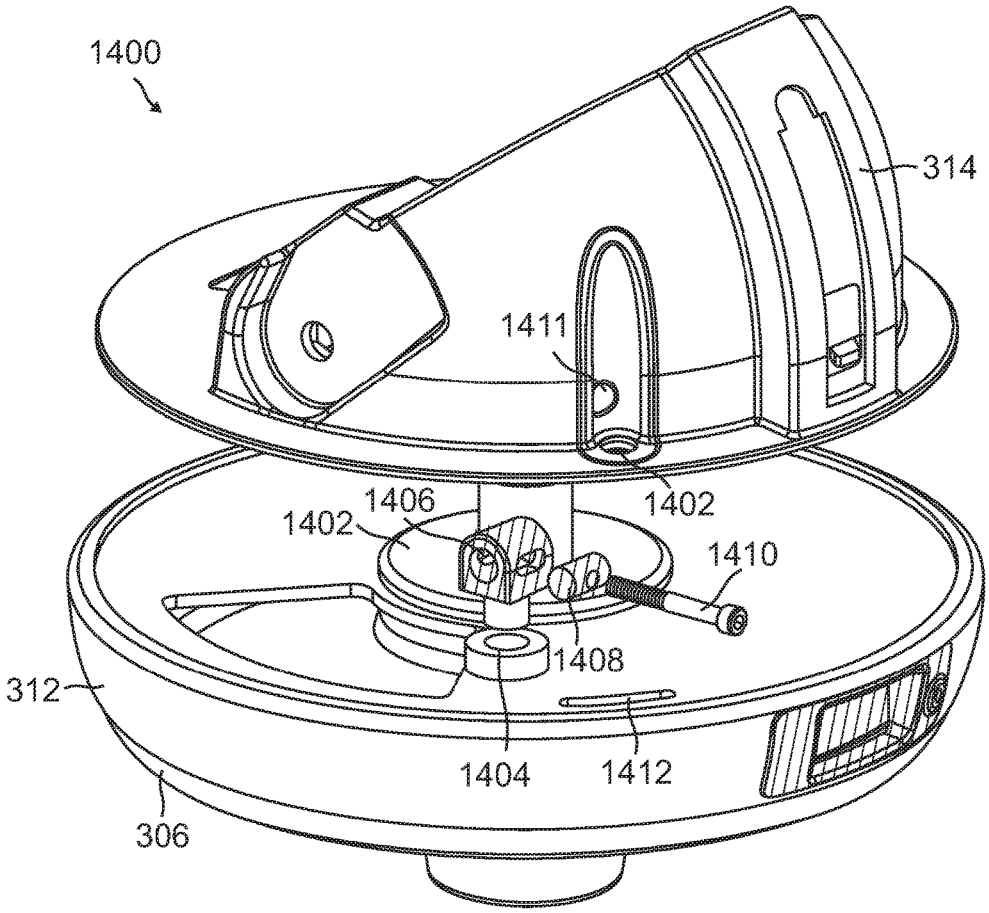
FIG. 14 is a diagram of the azimuth fine alignment system.

FIG. 14 is a diagram of the azimuth fine alignment system 1400. The fine alignment system 1400 comprises a stanchion 1406 rotatingly mounted to an aperture feature 1404 of the azimuth reticle member 312. The stanchion 1406 comprises an aperture 1406 through which a slidable and rotatable bolt member 1408 is positioned. Member 1408 also includes a threaded aperture for accepting a fine adjustment screw 1410 therethough. When positioned inside the aperture 1406, bolt member 1408 can rotate in the aperture 1406 about its longitudinal axis as well as slide outward and inward along its longitudinal axis. Fine adjustment screw 1410 also fits through an aperture 1411 in the elevation reference member 314 and is secured thereto. Since the head portion of the fine adjustment screw 1410 maintains the same spatial relationship with aperture 1411 as the screw 1410 is rotated, the elevation reference member 314 is rotated about the azimuth axis 416 (e.g. by tension applied by the fine adjustment screw 1410 between aperture 1411 and stanchion 1406). Once the proper fine azimuth alignment has been achieved, it may be fixed by a fixation screw (not illustrated) passed through fixation aperture 1402 and into an accepting aperture 1412 in the azimuth reference member 312.

Hence, the alignment apparatus 300 comprises two mechanisms to permit rotation of the antenna about the azimuth axis 416. The first mechanism permits rotation of the azimuth reference member 306 in relation to the azimuth reticle member 312 about the azimuth axis 416, and the second mechanism permits rotation of the elevation reference member 314 in relation to the azimuth reticle member 312 about the azimuth axis 416. These two independent means of adjusting the azimuth angle (fine and coarse) permit the alignment apparatus 300 to be coarsely aligned in azimuth, then fixed in coarse position, then finely aligned with greater resolution in azimuth and fixed in fine position. The azimuth fine adjust geometry rotates in unison with coarse azimuth until coarse lock, and then pivots independently around the same axis with finer resolution. The fine control mechanism uses a fastener through a sliding, pivoting nut 1408 to finely adjust the azimuth geometry relative to the base member 302.

Figure 15:
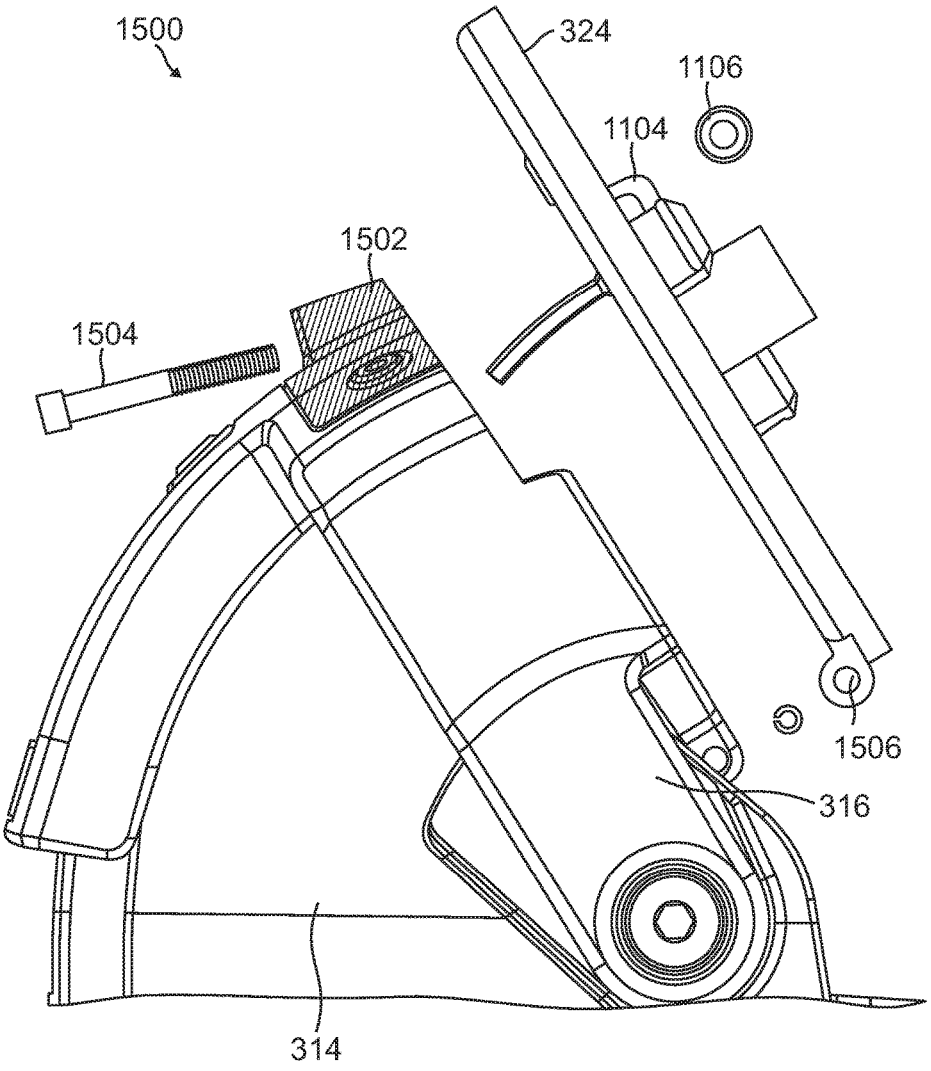
FIG. 15 is a diagram illustrating one embodiment of an elevation axis fine alignment adjustment mechanism.

FIG. 15 is a diagram illustrating one embodiment of an elevation axis fine alignment adjustment mechanism 1500. The mechanism 1500 includes a elevation stanchion 1502 mounted to the elevation reticle member 316. The stanchion 1502 holds the head of adjustment screw 1504 in place, and the threaded end of adjustment screw 1504 inserted into member 1106, which is held in place (but allowed to rotate along its longitudinal axis) by stanchion 1104. As a result, when adjustment screw 1504 is rotated, the tilt reticle member 324 is rotated about secondary axis 1102 (shown in FIG. 11). The tilt reticle member 324 is held in place (but allowed to rotate about secondary axis 1102) by fixing member 1506.

Figure 16:
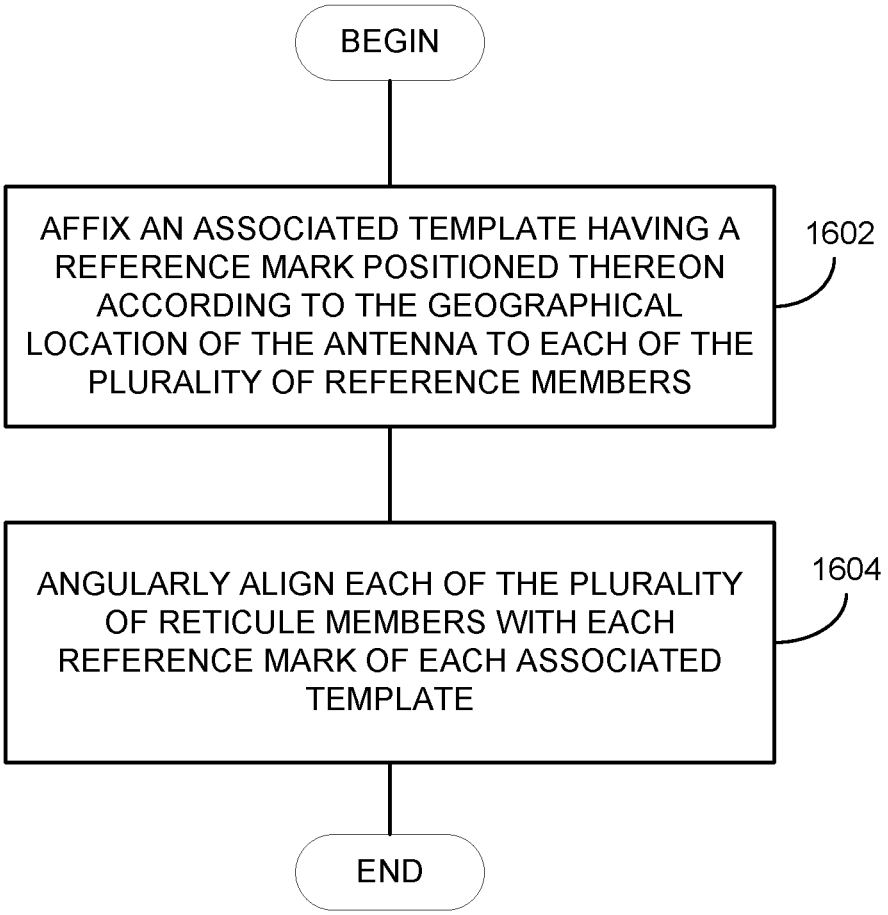
FIG. 16 is a diagram presenting exemplary process steps that can be performed to align an antenna using the alignment apparatus.

FIG. 16 is a diagram presenting exemplary process steps that can be performed to align an antenna using the alignment apparatus 300. In block 1602, an associated template having a reference mark is affixed to each of the plurality of reference members. The reference mark on each template is positioned according to the geographical location of the antenna. In block 1604, each of a plurality of reticle members are aligned with each reference mark of each associated template.

Figure 17:
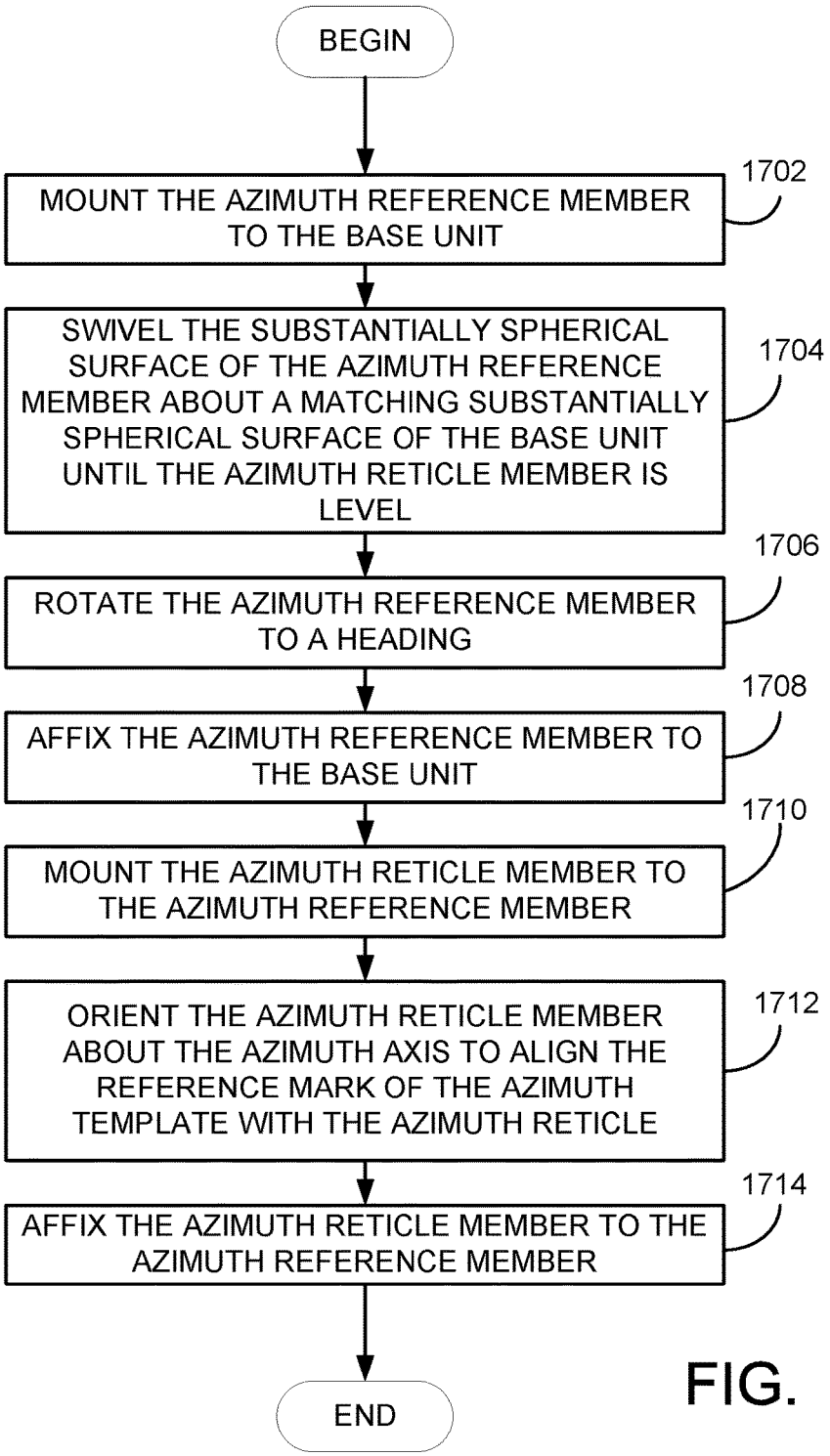
FIG. 17 is a diagram further presenting exemplary process steps for aligning the antenna using the alignment apparatus.

FIG. 17 is a diagram further presenting exemplary process steps for aligning the antenna using the alignment apparatus 300. In block 1702, the azimuth reference member 306 is mounted to the base unit 302. In block 1704, the substantially spherical surface of the azimuth reference member 306 is swiveled in relation to the matching substantially spherical surface 402 of the base unit 302 until the azimuth reference member 306 is level (for example, as indicated by level 406).

As shown in block 1706, the azimuth reference member 306 is then rotated about the gravity vector to orient the azimuth reference member 306 with respect to magnetic north. A magnetic compass 408 mounted on the azimuth reference member 306 can aid in this process. Preferably, the azimuth reference member 306 and nearby structures (e.g. the base 302 and mast 204 are non-magnetic to permit an accurate determination of magnetic north. In block 1708, the azimuth reference member 306 is affixed to the base member 302, for example, using locking ring member 404.

Next, the azimuth reticle member 312 is mounted to the azimuth reference member 306, as shown in block 1710. The azimuth reticle member 312 is then oriented (e.g. rotated) about the azimuth axis 416 to align the reference mark 702 of the azimuth template 310 with the azimuth reticle cursor 704, as shown in block 1712. Then, the azimuth reticle member 312 is affixed to the azimuth reference member 302 to prevent further motion between these two elements about azimuth axis 416, as shown in block 1714. This can be accomplished via azimuth affixing mechanism 510, which may comprise a screw.

Figure 18:
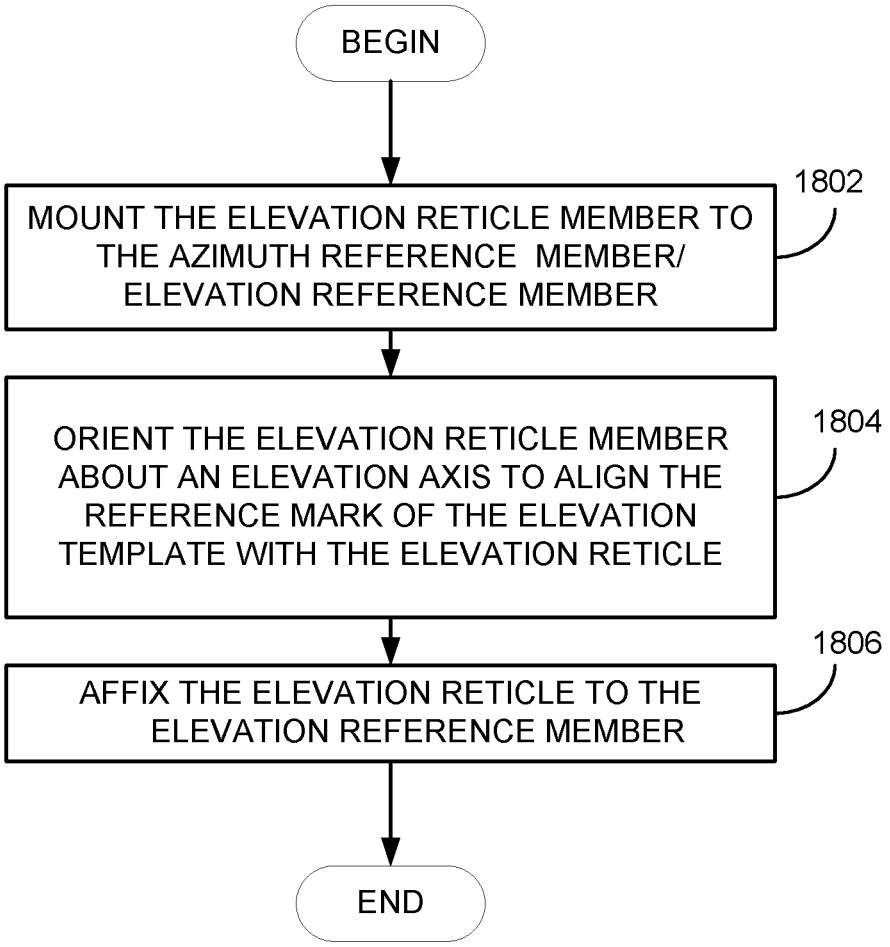
FIG. 18 is a diagram illustrating further process steps for aligning the antenna using the alignment apparatus.

FIG. 18 is a diagram illustrating further process steps for aligning the antenna using the alignment apparatus 300. In embodiments where the elevation reference member 314 is not pre-assembled to the azimuth reticle member 312, the next step is to mount the elevation reference member 314 to the azimuth reticle member 312. In embodiments where the elevation reference member 314 is preassembled to the azimuth reticle member, the elevation reference member 314 is mounted to the azimuth reticle member 312, as shown in block 1802. In block 1804, the elevation reticle member 316 is oriented (e.g. rotated) about the elevation axis 908 to align the reference mark 1004 of the elevation template 320 with the cursor 1002 of the elevation reticle 318. Once the elevation reticle member 316 and the elevation reference member 314 are properly oriented with respect to one another, they are affixed together using elevation affixing mechanism 1006, which may comprise a screw, as shown in block 1806.

Figure 19:
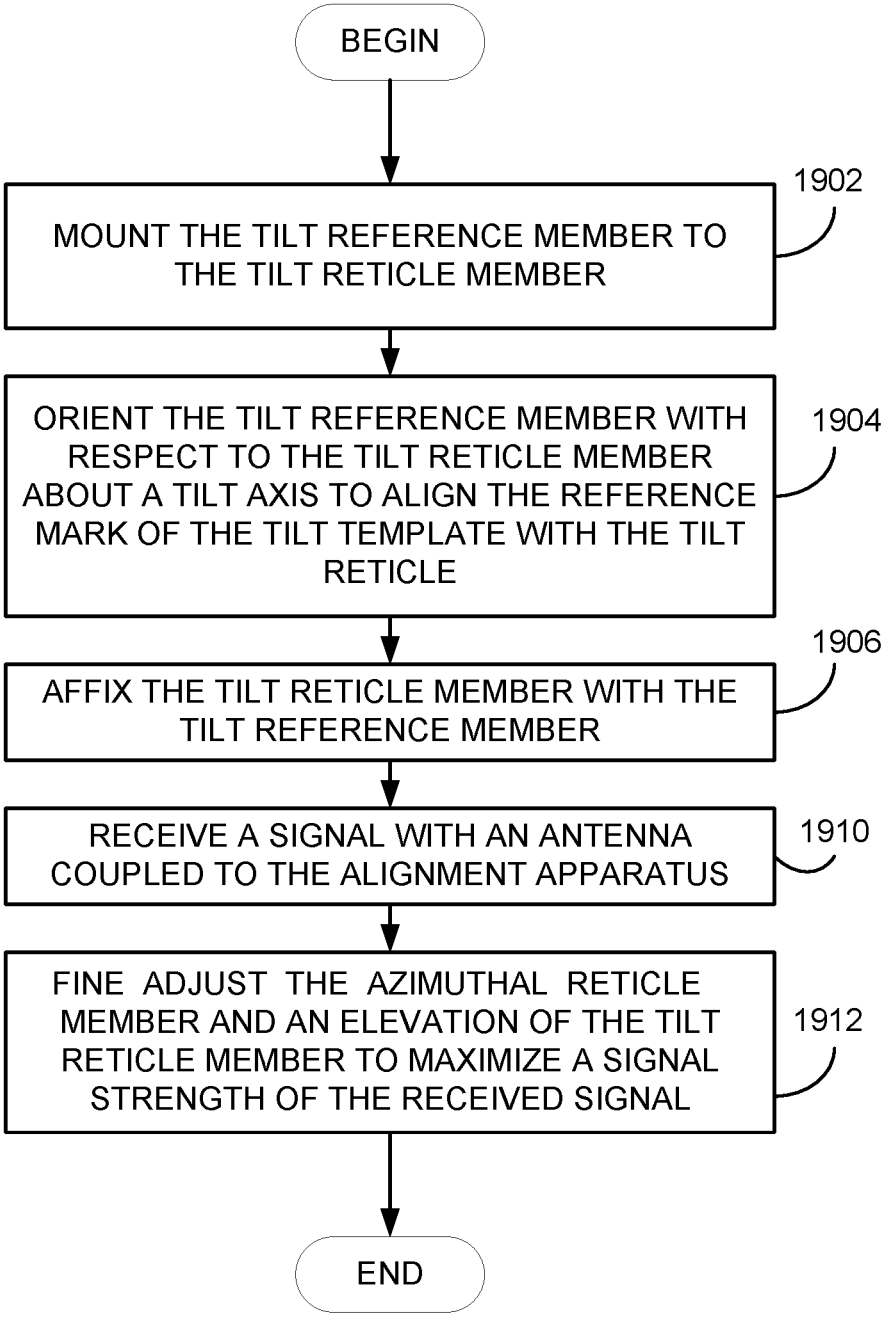
FIG. 19 is a diagram illustrating further process steps for aligning the antenna using the alignment apparatus.

FIG. 19 is a diagram illustrating further process steps for aligning the antenna using the alignment apparatus 300. In block 1902, the tilt reticle member 321 is mounted to the elevation reticle member 316. This step may be accomplished by the end-user or consumer, or the tilt reticle member 321 may be mounted to the elevation reticle member 316 when delivered to the customer. Next, the tilt reference member 322 is mounted to the tilt reticle member 321. The tilt reference member 322 is then oriented (e.g. rotated) about a tilt axis 1108 to align the reference mark of the tilt template 326 with the cursor 1202 of the tilt reticle 321, as shown in block 1904. In block 1906, the tilt reticle member 321 is affixed with the tilt reference member 322 to prevent further motion relative to one another.

Finally, in block 1910, a signal is received with an antenna coupled to the alignment apparatus 300, and the alignment apparatus 300 is fine aligned in both azimuth and elevation. This can be accomplished by adjusting the antennal assembly 300 alignment in azimuth and elevation (and optionally, tilt) to maximize a signal characteristic of a signal transmitted by a selected transponder 107 and received by the receiver 124.

This signal characteristic may be a measure of signal quality or signal strength measure. The transponder 107 selected for this fine alignment procedure may be a transponder 107 transmitting signals at frequencies for which the antenna has a narrower or narrowest beamwidth than other frequencies. In one embodiment permitting adjustment to within a few tenths of a degree, the fine alignment is performed in azimuth and elevation to peak the signal quality value for one Ka band transponders 107. One approach for fine alignment is to peak the signal received for one Ka-band transponder. The choice of transponder 107 is important because the signals polarization will impact bias introduced during the pointing process. The polarization used may depend on the Topocentric angle so that a right-hand circularly polarized transponder may be preferred for some installation locations and a left-hand circularly polarized transponder may be preferred at other locations.

This simplified peaking approach is different from other schemes that use dithering, but it is recognized that the dithering approach (and also other schemes that measure the signal-to-noise ratio for multiple transponders and then use a curve fitting approach to final the optimal position) may provide slightly better positioning and are more tolerant to mispointing errors.

Another approach is to utilize the three-axis magnetometer, three-axis accelerometer, and three-axis gyroscopes provided in many commercial smartphones to perform the antenna alignment. The accelerometers in such smartphones can be used to make at least some of the angular measurements that are needed for the elevation and tilt processes. This can be accomplished by use of an adapter that is permits the smartphone to be mounted to the several locations on the antenna alignment apparatus 300 and used to align the antenna in the proper direction. For example, the sensors in a smartphone can be used to perform the base leveling, pointing toward north, and setting the elevation and tilt angles (using the smartphone's accelerometers) described above.

Adapters can be used to (1) place the smartphone at the location of the compass 408 in FIG. 4B where it can be used for both leveling and bearing, (2) on the back of the elevation reticle member 316, disposed directly over the reticle 318, to set the elevation angle, and (3) at an appropriate location on the tilt reference member 322 to set the tilt. With this arrangement, the compass heading chosen may not be toward magnetic North, but toward the appropriate azimuth angle for the geographic location of the ODU because the azimuth reference template 310 would not be used. The coarse azimuth adjust geometry may mount so that it is indexed relative to the swivel base, thereby ensuring the correct azimuth orientation.

Figure 20A:
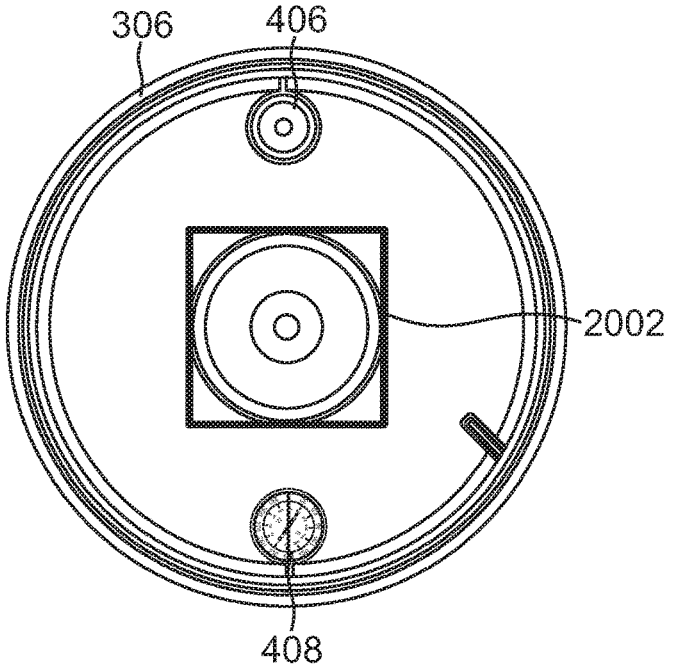
FIGS. 20A, 20B and 21 illustrate how a smartphone may be used to adjust the alignment apparatus.
Figure 20B:
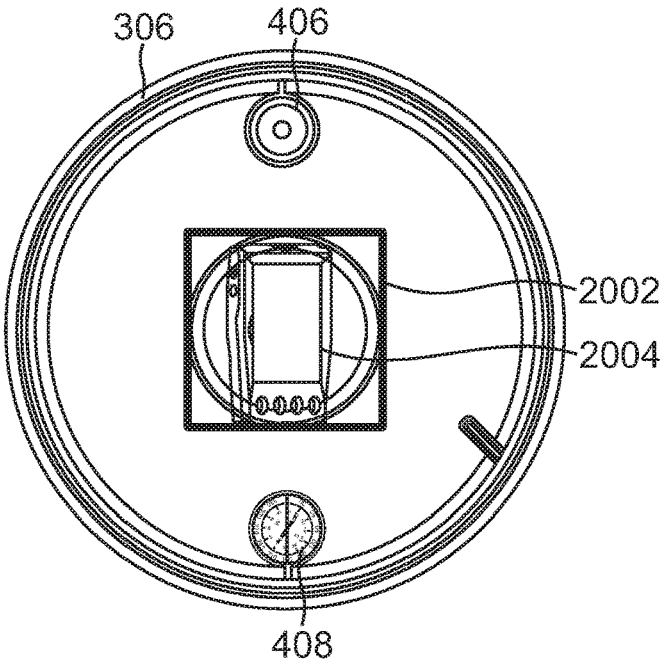

FIGS. 20A and 20B are diagrams illustrating how a smartphone 2004 may interface with the azimuth reference member 306 to perform the leveling and heading orientation operations. The structure orients the smartphone 2004 in a precision location and attitude relative to the other elements of the azimuth reference member. In the illustrated embodiment, a structure 2002 may be either integral with the azimuth reticle member, or the structure 2002 may be temporarily attached to the azimuth reference member 306 for the leveling and orientation and removed thereafter. The smartphone 2004 may be mounted on the structure 2002 and the compass and leveling features of the smartphone used to level and orient the azimuth reference member 306. This may also be accomplished via a specialized application that uses arrows or audio feedback such as beeps to assist the user in performing the leveling and orientation. For example, the smartphone application may be customized to the location of the installation, so that the user simply needs to execute the application and orient the smartphone until it beeps to perform the level operation, and further reorient the smartphone until it beeps to perform the heading operation.

Figure 21:
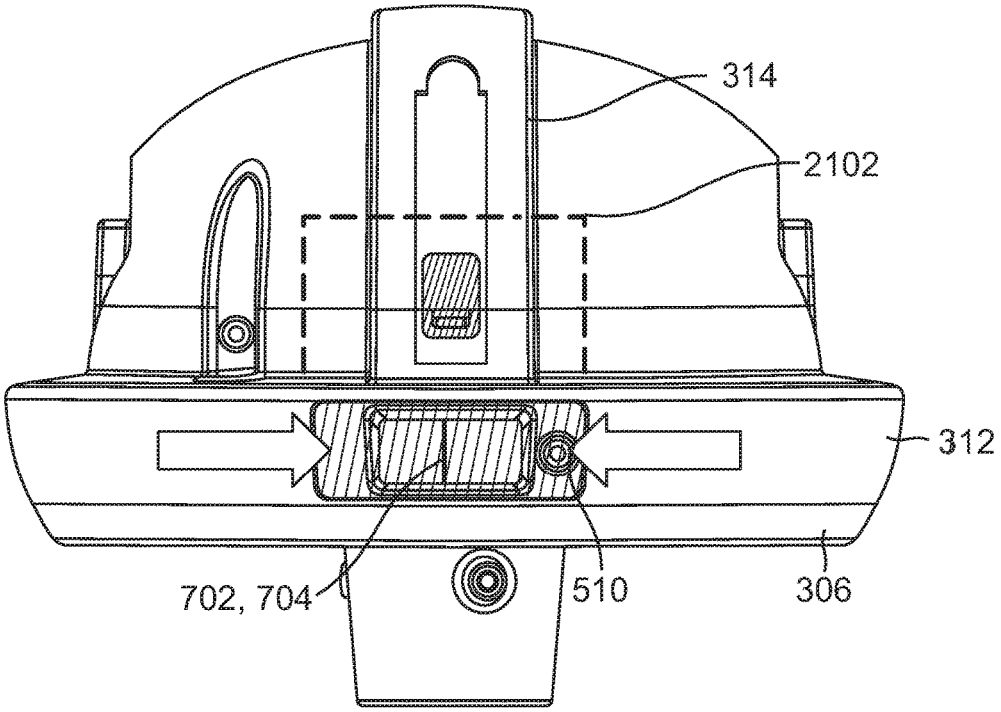

FIG. 21 illustrates a diagram of a further structure 2102 that can support a smartphone in a precision location and attitude. Azimuth alignment can be performed placing the smartphone 2004 on this structure. Similarly, tilt alignment can be performed by mounting the smartphone 2004 to a precision structure mounted to the tilt reference member 322.

Finally, alignment of the antenna in azimuth, elevation, tilt may all be accomplished by my mounting the smartphone 2004 to the alignment apparatus 300 as the antenna reflector 202 would be mounted to the tilt reference member 322, using mounting structures 1302. In this case, the alignment apparatus 300 may be placed in different alignment configurations, and the smartphone 2004 used to align the alignment apparatus 300 in about each axis one at a time, or at the same time, using aural or visual feedback.

The smartphone can also be used to aid in the fine adjustment of the alignment apparatus 300. For example, a smartphone can also be used to transmit information from the receiver 124 to the smartphone, thereby providing a portable display of the signal quality. Communications between the receiver 124 and the smartphone may be made via WiFi.

CONCLUSION

This concludes the description of the preferred embodiments of the present invention. The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An apparatus, for angularly aligning an antenna disposed at a geographical location, comprising:

a plurality of reticle members, each reticle member having a reticle; and a plurality of reference members, each adjustably engaged with an associated one of the plurality of reticle members;

wherein each of the plurality of reference members comprises an associated template having a reference mark positioned thereon according to the geographical location of the antenna and the antenna is angularly aligned when each reference mark of each template is aligned with the reticle associated with the reference mark.

2. The apparatus of claim 1, wherein each template and each associated reference member are aligned via matching physical features at the location.

3. The apparatus of claim 2, wherein the matching physical features comprise a reference member depression having a shape matching the associated template.

4. The apparatus of claim 2, wherein the matching physical features comprise a positioning hook.

5. The apparatus of claim 2, wherein the plurality of reference members are rotatably engaged with the associated one of the plurality of reticle members and wherein:

the plurality of reticle members comprises:

an azimuth reticle member having an azimuth reticle;

an elevation reticle member having an elevation reticle;

a tilt reticle member having a tilt reticle; and the plurality of reference members comprises:

an azimuth reference member having an azimuth template;

an elevation reference member having an elevation template; and a tilt reference member having a tilt template.

6. The apparatus of claim 5, wherein:

wherein the elevation reference member is integrated with the azimuth reference member.

7. The apparatus of claim 5, wherein:

the azimuth reticle member and azimuth reference member are rotatably engaged about an azimuth axis substantially co-linear with a gravity vector and rotatably adjustable to an azimuth alignment angle to align the antenna in azimuth when the reference mark of the azimuth template is aligned with the azimuth reticle.

8. The apparatus of claim 7, wherein:

the apparatus further comprises a base member having a base member surface substantially spherical about a base member axis; and the azimuth reference member comprises:

an azimuth reference member surface substantially spherical about the azimuth axis, swivelingly engaging the base member surface;

a bubble level for leveling the azimuth reference member; and a compass, for aligning the leveled azimuth reference member according to magnetic north.

9. The apparatus of claim 8, wherein:

the azimuth reference member surface is releasably affixed to the base member surface via a locking ring member; and the azimuth reference member surface is non-magnetic.

10. The apparatus of claim 8, wherein:

the elevation reticle member and elevation reference member are rotatably engaged about an elevation axis substantially perpendicular with the gravity vector and rotatably adjustable to an elevation alignment angle to align the antenna in elevation when the reference mark of the elevation template is aligned with the elevation reticle.

11. The apparatus of claim 10, wherein:

the tilt reticle member and tilt reference member are rotatably engaged about a tilt axis substantially perpendicular with the gravity vector and parallel to the elevation axis and rotatably adjustable to a tilt angle to align the antenna in tilt when the reference mark of the tilt template is aligned with the tilt reticle.

12. The apparatus of claim 11, further comprising:

an azimuthal fine alignment mechanism, coupled between the azimuth reference member and the elevation reference member, for rotating the elevation reference member about an azimuth axis relative to the azimuth reference member.

13. The apparatus of claim 11, wherein the elevation reticle member further comprises:

an elevation fine adjustment mechanism, coupled between the elevation reticle member and the tilt reticle member.

14. The apparatus of claim 1, wherein:

the apparatus further comprises at least one structure, for precision mounting of a smartphone, the smartphone for measuring and reporting an angular orientation of the apparatus.

15. The apparatus of claim 1, wherein each associated template is color-coded and comprises pre-printed marks indicating a desired antenna orientation.

16. A method for angularly aligning an antenna coupled to an alignment apparatus a geographical location, the alignment apparatus comprising a plurality of reticle members, each reticle member having a reticle, a plurality of reference members, each adjustably engaged with an associated one of the plurality of reticle members, affixing an associated template having a reference mark positioned thereon according to the geographic location of the antenna to each of the plurality of reference members; and angularly aligning each of the plurality of reticle members with each reference mark of each associated template.

17. The method of claim 16, wherein each template and each associated reference member are aligned via matching physical features at the location.

18. The method of claim 17, wherein the matching physical features comprise a positioning hook.

19. The method of claim 17, wherein the plurality of reference members are rotatably engaged with the associated one of the plurality of reticle members and wherein:

the plurality of reticle members comprises:

an azimuth reticle member having an azimuth reticle;

an elevation reticle member having an elevation reticle;

a tilt reticle member having a tilt reticle; and the plurality of reference members comprises:

an azimuth reference member having an azimuth template;

an elevation reference member having an elevation template; and a tilt reference member having a tilt template.

20. The method of claim 19, wherein the alignment apparatus comprises a base member having a base member substantially spherical about a base member axis, a level and a compass, and angularly aligning each of the plurality of reticle members with each reference mark of each associated template comprises:

mounting the azimuth reference member to the base member;

swiveling a substantially spherical surface of the azimuth reference member about a matching substantially spherical surface of the base member until the azimuth reticle member is level;

affixing the azimuth reference member to the base member;

mounting the azimuth reticle member to the azimuth reference member;

orienting the azimuth reticle member about an azimuth axis to align the reference mark of the azimuth template with the azimuth reticle; and affixing the azimuth reticle member to the azimuth reference member.

21. The method of claim 20, wherein the elevation reference member is integrated with the azimuth reticle member and angularly aligning each of the plurality of reticle members with each reference mark of each associated template further comprises:

mounting the elevation reference member to the azimuth reticle member;

orienting the elevation reticle member about an elevation axis to align the reference mark of the elevation template with the elevation reticle; and affixing the elevation reference member to the azimuth reticle member.

22. The method of claim 21, wherein the tilt reticle member is coupled to the elevation reticle member, and angularly aligning each of the plurality of reticle members with each reference mark of each associated template further comprises:

mounting the tilt reticle member to the elevation reticle member;

orienting the tilt reference member with respect to the tilt reticle member about a tilt axis to align the reference mark of the tilt template with the tilt reticle; and affixing the tilt reticle member to the elevation reticle member.

23. The method of claim 22, further comprising the steps of:

receiving a signal with an antenna coupled to the alignment apparatus; and fine adjusting the azimuthal reticle member and an elevation of the tilt reticle member to maximize a signal strength of the received signal.

24. The method of claim 23, wherein the signal is received from a Ku band transponder of a polarization selected according to the location.

25. The method of claim 23, further comprising:

receiving an indication of the signal strength of the received signal in a smartphone in wireless communication with the receiver.

* * * * *